United States Patent [19]

Nishikawa

[11] Patent Number: 4,651,487

[45] Date of Patent: Mar. 24, 1987

[54] WEAR-RESISTANT REFRACTORY LINING ANCHOR

[75] Inventor: Akira Nishikawa, Tokyo, Japan

[73] Assignee: Plibrico Japan Co., Ltd., Japan

[21] Appl. No.: 699,792

[22] Filed: Feb. 8, 1985

[30] Foreign Application Priority Data

Sep. 4, 1984 [JP] Japan ..... 59-183837

[51] Int. Cl.[4] ..... E04B 1/24; E04C 2/04

[52] U.S. Cl. ..... 52/378; 52/334; 52/443; 110/336

[58] Field of Search ..... 52/334, 378, 379, 443, 52/600, 249; 110/336

[56] References Cited

U.S. PATENT DOCUMENTS

| | | | |
|---|---|---|---|
| 1,433,232 | 10/1922 | Rogers | 52/443 |
| 1,590,650 | 6/1926 | Schack | 52/443 |
| 1,928,313 | 9/1933 | Gaylord, Jr. | 52/378 |
| 3,362,698 | 1/1968 | Cerney et al. | 432/119 |
| 3,564,799 | 2/1971 | Hanson | 52/334 |
| 4,479,337 | 10/1984 | Crowley | 52/378 |

FOREIGN PATENT DOCUMENTS

| | | | |
|---|---|---|---|
| 1011602 | 7/1957 | Fed. Rep. of Germany | 52/334 |
| 1178756 | 5/1959 | France | 52/378 |

*Primary Examiner*—John E. Murtagh
*Assistant Examiner*—Andrew Joseph Rudy
*Attorney, Agent, or Firm*—Roberts, Spiecens & Cohen

[57] ABSTRACT

A wear-resistant refractory lining anchor comprising a plurality of metal hollow elongated members each having a plurality of through holes, a plurality of projections, a plurality of recesses or a plurality of cut and raised portions, each of the plurality of metal hollow elongated members having one end welded to a casing. The plurality of metal hollow elongated members are disposed at predetermined intervals to support a refractory material filled inside and outside the plurality of metal hollow elongated members. This anchor has low material cost, can be easily mounted on a casing, and can stably support a refractory material filled inside and outside the metal hollow elongated members.

8 Claims, 10 Drawing Figures

WEAR-RESISTANT REFRACTORY LINING ANCHOR

BACKGROUND OF THE INVENTION

I. Field of the Invention

The present invention relates to an anchor suitably supporting a wear-resistant refractory lining mainly for oil refining apparatus, steelmaking equipment or the like.

II. Description of the Prior Art

Conventionally, wear-resistant refractory linings are provided in catalyst collecting cyclones of reactors and regenerators in an oil refining apparatus, communicating pipes between such reactors and regenerators, or in dust and material collecting cyclones in petrochemical and steelmaking equipment. In this case, a hexagonal mesh anchor, as shown in FIGS. 1A and 1B, having a height of about 19 to 25 mm is used to support a wear-resistant refractory material.

A hexagonal mesh is manufactured such that holes 1*a* and pawls 1*b* are formed in and on stainless steel bands to constitute a plurality of zig-zag bands 1 which are coupled to each other. When the hexagonal mesh is used as an anchor, the mesh is welded to a casing of a cyclone or a connecting pipe at welded portions w, as shown in FIG. 1B. A castable refractory material is sprayed or filled in the mesh to obtain the wear-resistant refractory lining.

The hexagonal mesh having a complicated shape must be cut and bent in accordance with the shape of an object to be provided with a lining. For example, in a cyclone, a conical portion is formed integrally with a cylindrical portion. The mesh must be cut in accordance with the shape of the cyclone. The cut portions must be welded to each other. In addition, the band 1 of the mesh must be bent at the angled portion between the cylindrical and conical portions in a direction perpendicular (a widthwise direction of the band 1) to the direction of the thickness of the band 1. Such machining is cumbersome, and a long machining time is required. A portion of the mesh which is cut and connected to another portion thereof loses its hexagonal shape, thus requiring sophisticated welding skills. In addition, the material cost is high, and thus the hexagonal mesh lining results in high cost.

Another conventional lining anchor is shown in FIG. 2. A lower edge of a metal support member 2 having end portions 2*a* and 2*b* bent in opposing directions is welded (reference symbol w represents a welded portion) to a casing. A number of metal support members are disposed at predetermined intervals, thereby constituting the lining anchor. However, this type of anchor has an unstable shape and is subjected to thermal distortion. In addition to these disadvantages, this anchor has only a small mechanical support force.

SUMMARY OF THE INVENTION

It is an object of the present invention to provide a wear-resistant refractory lining anchor, wherein material cost is low, the mounting operation is simple, and the mechanical support force is large.

In order to achieve the above object of the present invention, there is provided an anchor comprising metal hollow elongated members each having a plurality of through holes, projections, recesses and cut and raised portions, and one end of each of the hollow elongated members is welded to a casing, and the hollow elongated members are disposed at predetermined intervals.

According to the present invention, since a hollow elongated member can be prepared by machining mass-produced metal pipes, the low-cost hollow elongated members can be easily mounted in accordance with the shape of the object to be provided with a lining, thereby greatly decreasing the total cost. The refractory material can be stably filled inside and outside the hollow elongated members.

Other objects, features, and advantages of the present invention will be apparent from the detailed description in conjunction with the following accompanying drawings.

DETAILED DESCRIPTION OF THE PREFERRED EMBODIMENTS

Figure 1A:
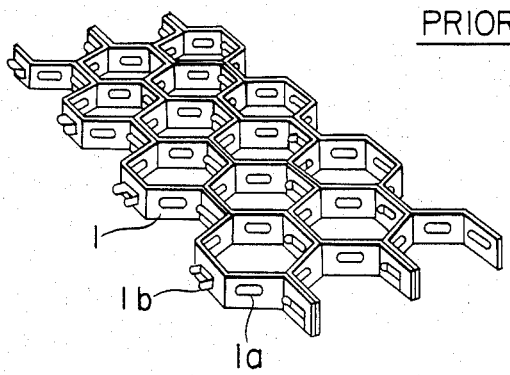
FIG. 1A PRIOR ART
FIGS. 1A and 1B are respectively a perspective view and a plan view of a conventional hexagonal mesh anchor.
Figure 1B:
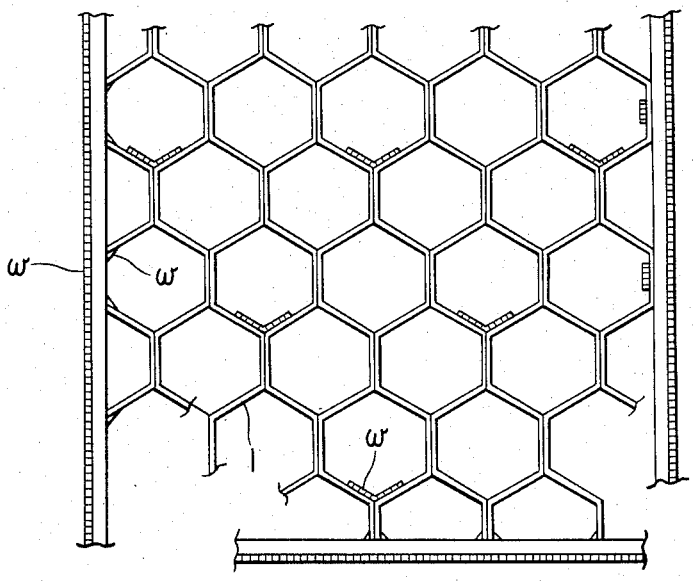
FIG. 1B PRIOR ART
Figure 2:
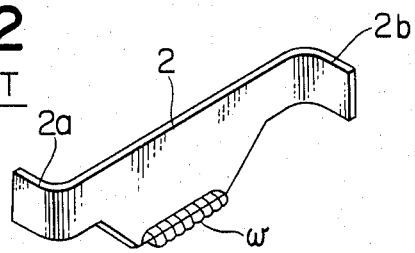
FIG. 2 PRIOR ART
FIG. 2 is a perspective view of another conventional anchor.
Figure 3A:
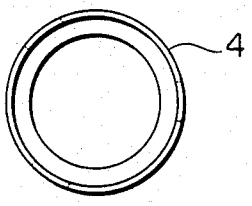
FIGS. 3A and 3B are respectively a plan view and a partially cutaway side view of a cylindrical member constituting an anchor according to an embodiment of the present invention.
Figure 3B:
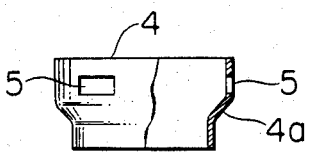
Figure 4:
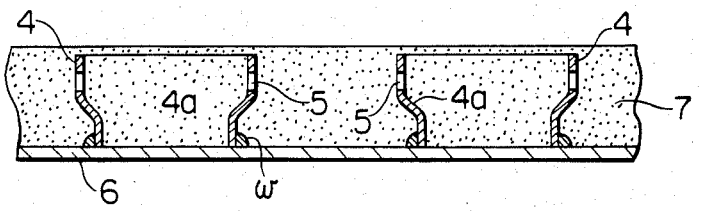
FIG. 4 is a sectional view of a lining using the cylindrical members shown in FIGS. 3A and 3B.

FIGS. 3A and 3B show an embodiment of the present invention. Reference numeral 4 denotes a stainless steel cylindrical member having a step portion 4*a* at an intermediate portion thereof. The cylindrical member 4 has a height of 19 mm and a plurality of through holes 5 in its wall surface. This cylindrical member 4 can be formed such that a commercially available stainless steel pipe is cut into pieces each having a predetermined length, and the resultant pieces are pressed, thus producing the cylindrical member 4 at low cost.

When the cylindrical member 4 is used as an anchor, the small-diameter end portion is welded to a casing 6 at welding portions w. In this case, the entire edge of the small-diameter end portion need not be welded. A plurality of cylindrical members 4 are disposed at predetermined intervals or in a checkerboard manner throughout the entire area of the casing 6. A refractory material 7 is filled inside and outside the cylindrical members 4 and is hardened.

The refractory material filled inside the cylindrical member 4 is connected to that outside the same cylindrical member 4 through a through hole 5 formed therein. In addition, the refractory material surrounding the cylindrical member 4 is fixed by the step portion 4*a*. Therefore, the refractory material as a whole can be firmly supported by the cylindrical anchor members.

According to this embodiment, the individual cylinders are welded to the casing 6, and cutting or coupling is not required unlike in the hexagonal mesh anchor.

Therefore, special skills are not required for the simple mounting operation.

Figure 5A:
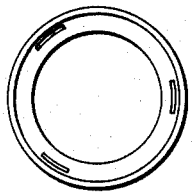
FIGS. 5A and 5B are respectively a plan view and a partially cutaway side view of a conical member according to another embodiment of the present invention.
Figure 6A:
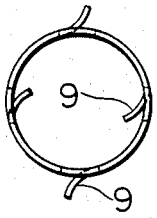
FIGS. 6A and 6B are respectively a plan view and a partially cutaway side view of a cylindrical member according to still another embodiment of the present invention.
Figure 5B:
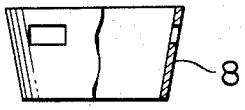
Figure 6B:
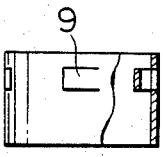

FIGS. 5A and 5B, and FIGS. 6A and 6B show other embodiments of the present invention, respectively. Referring to FIGS. 5A and 5B, the anchor member has the frustoconical shape, and a small-diameter end portion is welded to the casing. The anchor member shown in FIGS. 6A and 6B has a plurality of cut and raised portions 9 each of which is obtained such that a wall thereof is partially cut and an inner portion defined along a cutting line is bent at an uncut portion thereof. These anchor members have low material cost, can be easily mounted on the casing, and stably support the refractory material in the same manner as in FIGS. 3A and 3B.

In the above embodiments, cylindrical members are exemplified. However, the hollow anchor member may have a triangular or polygonal cross section to obtain the same effect as in the above embodiments. Through holes, projections, recesses and cut and raised portions may be formed singly or in a combination thereof to improve the anchoring effect.

According to the present invention, the anchor is manufactured at low cost and can be easily fixed on the casing in accordance with the shape of the casing. Therefore, as compared with the conventional hexagonal mesh anchor, the total cost can be greatly decreased. In addition the, design can be simplified, the work period can be shortened, and repairs can also be simplified. Furthermore, the anchor according to the present invention has sufficient mechanical strength and is resistant to thermal distortion.

What is claimed is:

1. A wear-resistant refractory lining anchor comprising a plurality of hollow, elongated, metal members, each member including an annular wall defining a hollow interior and opposite open ends, each of said plurality of metal hollow elongated members being welded at one of its ends to a casing, said plurality of hollow, elongated members being disposed at predetermined intervals on said casing to support a refractory material on said casing filled inside and outside said plurality of hollow elongated members, said refractory material which is filled inside and outside said hollow members being in contact with the casing at opposite sides of said walls of said hollow members at said one ends thereof, said walls including anchoring means for anchoring each member to the refractory material, the end of each elongated member welded to the casing being open thereat over the entire extent of the annular wall at the inner surface thereof, said annular wall being devoid of radial projections at said open ends, the wall of each hollow, elongated member having a radial edge at said one end which abuts against said casing.

2. An anchor according to claim 1, wherein the wall of each hollow, elongated member is frustoconical, said one end which is welded to said casing having a smaller diameter than that of the other end.

3. An anchor according to claim 1, wherein the wall of each hollow, elongated member has an intermediate step portion, said one end which is welded to said casing having a diameter smaller than that of the other end.

4. An anchor according to claim 1 wherein said anchoring means provides communication between the interior and exterior of each member.

5. An anchor according to claim 4 wherein said anchoring means includes a plurality of through holes in each said wall.

6. An anchor according to claim 4 wherein said anchoring means comprises projections extending from each said wall.

7. An anchor according to claim 4 wherein said anchoring means comprises cut and raised portions extending from each said wall.

8. An anchor according to claim 1 wherein said annular wall at said open end extends substantially perpendicularly to said casing.

* * * * *